US005368775A

United States Patent [19]

Rossi et al.

[11] Patent Number: 5,368,775

[45] Date of Patent: Nov. 29, 1994

[54] CORROSION CONTROL COMPOSITION AND METHOD FOR BOILER/CONDENSATE STEAM SYSTEM

[75] Inventors: Anthony M. Rossi, Vincentown, N.J.; Alexander C. Mc Donald, Houston, Tex.

[73] Assignee: Betz Laboratories, Inc., Trevose, Pa.

[21] Appl. No.: 74,082

[22] Filed: Jun. 8, 1993

Related U.S. Application Data

[63] Continuation-in-part of Ser. No. 872,202, Apr. 22, 1992, abandoned, which is a continuation-in-part of Ser. No. 217,489, Jul. 11, 1988, abandoned.

[51] Int. Cl.[5] ..... C23F 11/14

[52] U.S. Cl. ..... 252/392; 422/16

[58] Field of Search ..... 252/392; 422/16

[56] References Cited

U.S. PATENT DOCUMENTS

| | | | |
|---|---|---|---|
| 2,582,138 | 1/1952 | Lane et al. | 252/180 |
| 3,029,125 | 4/1962 | Hummel | 422/16 |
| 4,192,844 | 3/1980 | Trace et al. | 422/16 X |
| 4,279,767 | 7/1981 | Muccitelli | 252/392 X |
| 4,289,645 | 9/1981 | Muccitelli | 252/390 X |
| 4,350,606 | 9/1982 | Cuisia et al. | 252/392 |
| 4,430,196 | 2/1984 | Niu | 252/392 X |
| 4,487,708 | 12/1984 | Muccitelli | 252/392 X |
| 4,490,275 | 12/1984 | Niu | 252/390 X |
| 4,549,968 | 10/1985 | Muccitelli | 210/750 |
| 4,562,042 | 12/1985 | Moran | 422/13 |
| 4,569,783 | 2/1986 | Muccitelli | 252/188.28 X |
| 4,626,411 | 12/1986 | Nemes et al. | 422/13 |
| 4,681,737 | 7/1987 | Walker et al. | 422/16 |
| 4,726,914 | 2/1988 | Fellows et al. | 252/392 |

OTHER PUBLICATIONS

"Condensate Corrosion Control Improves Boiler Reliability", Oil and Gas Journal, Nov. 1987.

"Betz Handbook of Industrial Water Conditioning", 1980, pp. 144–149.

"Betz Handbook of Industrial Water Conditioning", 8th ed., 1980; pp. 78–84.

*Primary Examiner*—Robert L. Stoll

*Assistant Examiner*—Valerie Fee

*Attorney, Agent, or Firm*—Alexander D. Ricci; Steven D. Boyd

[57] ABSTRACT

A corrosion control composition and method for boiler/condensate steam systems is provided. Corrosion is controlled by the addition to the feedwater of a relatively high molecular weight amine. The high molecular weight amine is formulated so that at the conditions of temperature and pressure in the boiler/condensate steam system, partial degradation into more volatile amines occurs. The resulting blend of neutralizing amines provides the superior corrosion control of a blend of neutralizing amines from a single amine feed. The preferred high molecular weight amine is dimethylaminopropylamine which will partially degrade into dimethylamine, trimethylamine, methylamine, and dimethylaminopropanol.

3 Claims, 1 Drawing Sheet

Figure 1 : Amine Decomposition
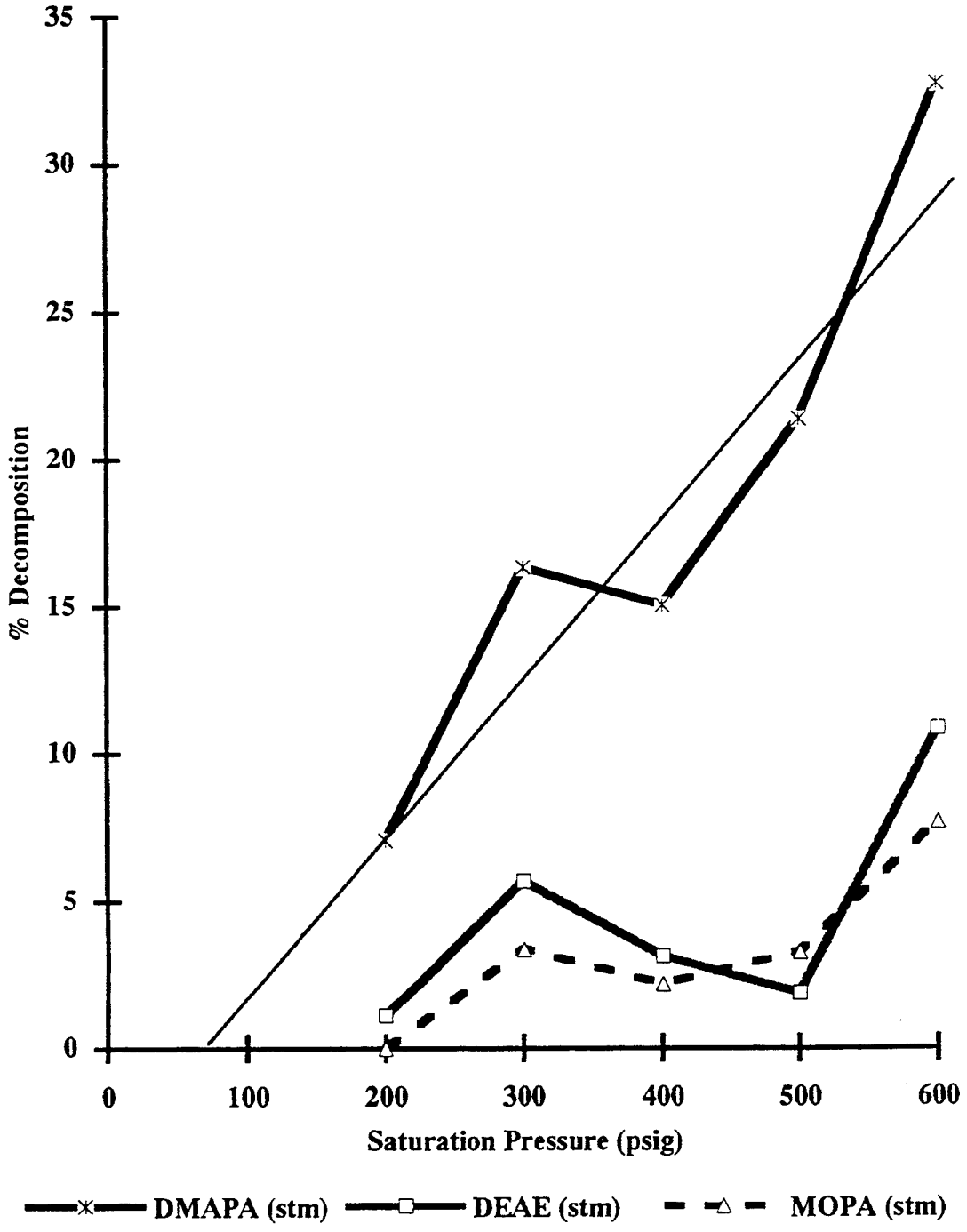

CORROSION CONTROL COMPOSITION AND METHOD FOR BOILER/CONDENSATE STEAM SYSTEM

This application is a continuation-in-part of application Ser. No. 07/872,202 filed Apr. 22, 1992, now abandoned which is a continuation-in-part of application Ser. No. 07/217,489 filed Jul. 11, 1988 now abandoned.

FIELD OF THE INVENTION

The present invention relates to compositions and methods for controlling the metal loss in boiler/condensate steam systems.

BACKGROUND OF THE INVENTION

Iron and copper corrosion in steam condensate systems results in damage to piping and equipment as well as the loss of high quality water and energy. The corrosion products and process chemicals if returned to the boiler can contribute to the formation of damaging boiler deposits thereby reducing the overall system reliability and increasing operating and maintenance costs.

Iron corrodes in water in the absence of oxygen because iron is less noble than hydrogen. In pure water the ferrous hydroxide ($Fe(OH)_2$) formed by iron and water elevates the pH by providing hydroxide ions and ferrous ions. This reduces the amount of hydrogen ion which tends to retard corrosion. If the water temperature rises, ferrous hydroxide is converted to magnetite ($Fe_3O_4$) in the absence of oxygen to form a somewhat protective film barrier. At temperatures of over 120° F., magnetite is formed based upon the overall reaction:

$$3\ Fe+4\ H_2O—Fe_3O_4+4H_2.$$

Thus, under laboratory conditions the corrosion of iron is self limiting. For actual condensate systems however, the presence of contaminants such as dissolved oxygen and carbon dioxide promote the corrosion reaction. In the presence of oxygen, ferrous hydroxide is unstable and ferric hydroxide is formed. Ferric hydroxide is not a corrosion reaction inhibitor as is ferrous hydroxide. Therefore, the presence of free oxygen in a given system enhances the corrosion reaction.

In addition to iron corrosion in water which is augmented by the presence of oxygen, corrosion of copper by oxygen may also occur. Generally, the resulting formation of cuptic oxide is self limiting. If, however, copper complexing agents such as ammonia are present, the copper oxide film cannot become permanently established. Therefore, the presence of ammonia such as from the in-situ decomposition of higher molecular weight amines is undesirable. High concentrations of carbon dioxide in the condensate system, at lower pH values (less than 8) have an effect similar to ammonia in dissolving the copper oxide film.

Carbon dioxide that dissolves in water causes the pH to be depressed and results in the formation of carbonic acid. Carbonic acid promotes the iron corrosion reaction by supplying the reactant $H^+$. The overall reaction is:

$$2H_2CO_3+Fe—Fe(HCO_3)_2+H_2.$$

The ferrous bicarbonate is soluble under many conditions and can act as a corrosion reaction retardant. The stability of ferrous bicarbonate in solution is effected by heat, pH and the partial pressure of carbon dioxide above the condensate. Often, these conditions change from location to location within the boiler/condensate system.

In the boiler, sodium carbonate and sodium bicarbonate react with heat plus water to form sodium hydroxide and carbon dioxide. Various external makeup water treatment methods can reduce the potential for carbon dioxide corrosion by lowering the alkalinity of the makeup water.

Due to the aqueous solubility of carbon dioxide, ground waters and surface waters contain carbonates among other dissolved solids. When these waters are heated in steam generating systems, the solubility of carbon dioxide decreases and the gas enters the produced steam. Upon condensation, carbon dioxide again dissolves to form carbonates. Since the condensate contains relatively few dissolved solids and thus little buffering capacity, the weakly acidic carbonate species can drastically lower the condensate pH. In turn, when acidic condensate mixes with makeup water, the steam generator feedwater pH can also decrease.

Carbonate containing waters cause acidic or general corrosion of the iron and copper metallurgies found in condensate and feedwater systems. This type of corrosion is evidenced by a general wastage or by gouging or pitting of the metal surface. If untreated, corrosion can cause failure of condensate return lines, feedwater piping, and other equipment (condensate receivers, pumps, heaters, etc.) associated with steam generator and hot water heating systems.

Several methods have been devised to control acid induced corrosion in these systems. Materials can be added that adsorb to the metal surface to form a thin barrier between the metal and the acidic solution. Examples of effective barrier-forming materials that are routinely used are long chain amines, such as octadecyl amine, and azoles, such as tolyltriazole.

A second, more often utilized method of controlling carbonate-caused corrosion is the addition of amines to neutralize the carbonate and thereby increase the aqueous pH. Many different amines are utilized, but some commonly used materials include cyclohexylamine, morpholine, and methoxypropylamine. On an equal weight basis, the most effective amines are those that possess high basicity and low molecular weight. The high basicity allows attainment of high pH after acid neutralization, and low molecular weight allows greater molar concentrations (and thus more neutralization).

The addition of neutralizing amines neutralizes the acid ($H^+$) generated by the solution of carbon dioxide in condensate. The amines hydrolyze in water to generate hydroxide ions required for neutralization. By regulating the neutralizing amine feed rate, the condensate pH can be elevated to within a desired range (e.g. 8.5 to 9.0). Numerous amines can be used for condensate pH neutralization and elevation. The selection of the appropriate amine is currently controlled by the basicity, stability and distribution ratio characteristics of the particular amine. Stability of amines fed to a boiler system was considered to be important due to the concern with regard to decomposition into ammonia. The distribution ratio (DR) of an amine is expressed as formula DR equal to amine in vapor phase divided by amine in water phase (condensate) at some defined pressure or temperature.

Amines with a distribution ratio greater than 1.0 have more amine in the vapor phase than the water phase. The distribution ratio is a function of the pressure and the temperature in a boiler/condensate system to be treated. Distribution ratios (at atmospheric pressure}for commonly used neutralizing amines are as follows: Morpholine 0.4; diethylaminoethanol 1.7; dimethylisopropanol amine 1.7; cyclohexylamine 4.0; ammonia 10.0. The varying distribution ratios of commonly used neutralizing amines affect the loss of the amine from the system as well as the area in the system where the amine is most effective. Amines that have low distribution ratios provide excellent pH control at initial condensation sites, but poor neutralization at the final condensation sites. On the other hand, high DR amines are more likely to be found in remote sites in steam that has been in contact with the liquid phase as it passes through the steam distribution system.

In boiler/condensate systems where the bulk of the steam produced is used for turbine supply, morpholine is most suitable or a blend having a high morpholine content. The low DR for morpholine means that morpholine will be present in the initial condensate formed at the wet end of the turbine. In plants with extensive runs of steam lines, a material with a high DR is more desirable. In practice, the best protection is typically provided by a blend of amine products containing a variety of materials with differing distribution ratios.

Typical neutralizing amines have DR's from 0.1 to 10, carbon dioxide has a DR of 100 or more depending upon temperature. Because of this difference in DR's, amines tend to concentrate in the condensate lines closest to the system boiler where as carbon dioxide tends to concentrate in more remote areas of the condensate return system. Thus, conventional amine addition to the boiler feedwater is not sufficient to protect such remote areas from carbon dioxide induced corrosion, often these lines are unprotected or require satellite feed of amines.

Amines having a relatively high volatility compared to the above treatment amines are known. For example, dimethylamine (DMA) trimethylamine (TMA), and diethylamine (DEA) have properties that make them desirable for use in corrosion inhibition in boiler/condensate systems. For example, DMA which has a DR of from 2 to 5, is an extremely strong base (pKa of 10.77) and due to its molecular weight is capable of neutralizing carbonic acid on an approximately 1:1 molar ratio. TMA is between 2–5 times more volatile than cyclohexylamine at boiler pressures from 100 to 1500 psig. DEA has a distribution ratio (at 1000 psig) of 28. Cyclohexylamine is the most volatile neutralizing inhibitor commonly used in the treatment of steam boiler/condensate systems. Thus, it is believed that DMA, TMA, DEA and other low molecular weight amines would be more effective than cyclohexyl amine and other amines used for condensate treatment in following and neutralizing carbon dioxide in the outlying areas of a condensate return system. However, the extreme volatility, i.e. flammability and high atmospheric vapor pressures, of low molecular weight amines has prevented the production of acceptable product formulations containing volatile, low molecular weight amines such as DEA, DMA and TMA for use in boiler/condensate system corrosion treatment.

BRIEF DESCRIPTION OF THE DRAWINGS

FIG. 1 is a plot of % Decomposition versus Saturation Pressure for three different amines.

OF THE INVENTION

The present invention provides a composition and method for controlling corrosion in boiler/condensate aqueous systems. The method of the present invention comprises the addition of a relatively high molecular weight amine to the feedwater of a boiler/condensate water system. The high molecular weight amine partially decomposes, either through hydrolytic cleavage or thermal degradation, to provide more volatile lower molecular weight amines. The lower molecular weight amines in combination with undecomposed high molecular weight amine provide corrosion control. Such a combination provides corrosion control by amines with a range of distribution ratios. The high molecular weight amine is selected so that at the conditions of temperatures and pressures in the boiler/condensate steam system being treated at least partial decomposition to lower molecular weight amines such as monobasic alkyl amines occurs. Such lower molecular weight amines such as DMA, TMA and DEA are highly volatile and flammable so their addition to the system feedwater in that form presents problems in handling and shipping. Thus, the feed of a single, relatively high molecular weight amine which is relatively easy to handle gives rise in the boiler system to a mixture of several amines which cover a broad range of distribution ratios and thus provides effective coverage of even complex boiler/condensate systems.

The preferred relatively high molecular weight amine of the present invention is dimethylaminopropylamine or N,N-dimethyl 1,3-propanediamine (DMAPA). DMAPA partially decomposes at specific boiler conditions to provide monobasic amines such as dimethyl amine (DMA) and trimethylamine (TMA}. Other relatively high molecular weight amines may also be employed which will partially decompose at boiler conditions. For example, diethylaminoethanol (DEAE) will partially decompose at common boiler conditions to ethylaminoethanol (EAE) and diethylamine (DEA). The mechanism of decomposition is not clearly understood but it is believed to be a form of hydrolytic cleavage or thermal degradation.

DESCRIPTION OF THE PREFERRED EMBODIMENT

The inventors of the present invention attempted to produce acceptable boiler water/condensate system control agent formulations containing a DMA and TMA and other volatile low molecular weight amines. Research into the effectiveness of TMA as a condensation system corrosion control agent indicated that TMA was 2 to 5 times more volatile than cyclohexylamine. Research also indicated that DMA has a DR of from 2 to 5, is an extremely strong base and is capable of neutralizing carbonic acid on approximately 1:1 molar bases. All of these properties indicated a possibility of improved condensate system control through the use of DMA or TMA. Attempts to develop product formulations containing low molecular weight amines which typically have extremely high atmospheric vapor pressures and are highly flammable were unsuccessful. These properties made the use of relatively low molecular weight amines such as DMA and TMA hazardous and complicated. In addition, DMA and TMA are hazardous to formulate and store limiting their usefulness in commercial settings.

The inventors of the present invention discovered that a relatively high molecular weight amine could be formulated which when exposed to temperature and pressure conditions in a boiler system would partially decompose into the desirable, relatively volatile low molecular weight amines essentially free of ammonia. By providing a relatively high molecular weight amine, only a single amine need be formulated, transported, stored and fed to a boiler system. The relatively high molecular weight of the feed amine results in a less volatile amine which is easier to transport, store and to feed. Proper formulation of the single relatively high molecular weight amine provides for partial decomposition at the conditions of temperature and pressure of the boiler being treated. The relatively high molecular weight amine is formulated such that upon the partial decomposition relatively low molecular weight amines are formed. Thus, the single feed amine of the present invention provides for the in situ formation, through decomposition, of a mixture of several amines in the boiler/condensate system. These several amines exhibit a broad range of distribution ratios to provide effective corrosion control even in complex boiler/condensate systems.

The preferred relatively high molecular weight amine of the present invention is dimethylaminopropylamine (DMAPA) or N,N-dimethyl-1,3-propanediamine. It has been found that the DMAPA is relatively easy to formulate, transport, store and feed as a single amine. When DMAPA is subjected to common boiler temperatures and pressures of from 100, and preferably over 200, to 1500 psig, the DMAPA will partially decompose. The partial decomposition of DMAPA forms DMA and TMA. The properties of these components, including their DR is given in Table I.

TABLE I

| Amine | Molecular Weight | Basicity (pKa) | Distribution Ratios 100 psig | 200 psig | 600 psig | Flash Pt. °F. |
|---|---|---|---|---|---|---|
| DMAPA | 102 | 10.0/8.2 | 1.1 | 1.9 | 2.0 | 84 |
| DMA | 45 | 10.8 | 2.4 | 2.1 | 3.3 | 60 |
| TMA | 59 | 9.8 | 15.3 | 12.6 | 28.0 | 20 |

The following lab scale experiment verified the formation of DMA and TMA.

A research scale, electrically heated test boiler was charged with nitrogen sparged (a mechanical deaeration), demineralized water. The water was supplied by high pressure pump to a D-configuration stainless steel boiler having an internal volume of approximately 5 liters. Two 4000 watt Incoloy 800 resistance heaters produced a steam rate of approximately 17 lbs/hr at a steam pressure of 1,450 psig (correspond to a temperature of 593° F.).

Cycles of concentration were held at approximately 15 by controlling boiler blowdown rate to 1.1 lbs/hr. The saturated steam produced was routed back into the feed tank and mixed with the original feedwater. This follows common industry practice where for economy the maximum amount of condensate is returned to the boiler as feedwater. The feedwater initially contained 200 ppm of DMAPA (Aldrich 99%) and 1.4 ppm hydrazine for deaeration. The feedwater (to which the condensed steam was recycled) was analyzed by gas chromatography and DMA and TMA were quantitated by comparison to external standards. Table II summarizes the results.

TABLE II

| Sample | Elapsed Time (hrs.) | Feedwater Composition (ppm) DMA | TMA | pH | Conductivity (uS) |
|---|---|---|---|---|---|
| 12 | 22 | 5 | 9 | 10.35 | 160 |
| 13 | 46 | 11 | 16 | 10.40 | 195 |
| 14 | 79 | 20 | 25 | 10.65 | 200 |
| 15 | 94 | 25 | 32 | 10.35 | 230 |

As shown, the addition of the single amine, DMAPA resulted in a steadily increasing concentration of DMA and TMA with time. The elevation in pH is believed to be due to the formation of highly basic DMA while the increase in conductivity is believed to be due to the increasing concentrations of DMA and TMA in the steam, both of which are significantly more volatile than DMAPA. Testing at varying boiler pressures has indicated a relationship between boiler pressure, the rate, and extent at which DMAPA decomposes into DMA and TMA.

The effects of common boiler/condensate temperature and pressure on relatively high molecular weight amine was studied. The relatively high molecular weight amines methoxypropylamine (MOPA) and DMAPA were exposed to boiler condition and the steam concentrations of the feed amines measured. From this information the percent decomposition was calculated. Table III summarizes the results:

TABLE III

| Amine | Pressure (PSIG) | Feedwater Concentration (ppm) | Steam Concentration (ppm) | % Decomposition |
|---|---|---|---|---|
| MOPA | 1500 | 61 | 58 | 4.9 |
| MOPA | 2500 | 61 | 46 | 24.6 |
| DMAPA | 200 | 106 | 98.4 | 7.1 |
| DMAPA | 600 | 106 | 78.8 | 25.7 |
| DMAPA | 900 | 106 | 68.7 | 35.2 |
| DMAPA | 1450 | 106 | 37.3 | 64.8 |

As shown by Table III MOPA is essentially stable at boiler conditions of 1500 psig while DMAPA undergoes significant decomposition at this pressure. Thus, DMAPA partially decomposes to effective amounts of relatively lower molecular weight amines at boiler/condensate conditions while MOPA does not. The present invention is directed toward the discovery that the feed of a single relatively high molecular weight amine such as DMAPA which will at least partially decompose is a safe and convenient method of treating a boiler/condensate system with a range of amines, including volatile, flammable relatively low molecular weight amines.

Additional testing in a research boiler was undertaken at pressures of from 200 to 600 psig in 100 psig steps. The high molecular weight amines tested included DMAPA, DEAE and MOPA. The boiler system was operated at 100% condensate return at 15 cycles. Feed tank, steam and blowdown samples were taken at the end of each run and analyzed by gas chromatograph (GC). The analysis provide a "snapshot" of deomposition and is summarized in FIG. 1.

A condensate modeling system was used to simulate the boiler runs and estimate. The theoretical steam concentration possible if no amine decomposition occurred. Using the theoretical concentration and the analytical value obtained from GC analysis, the percent decomposition was calculated and the results summarized in FIG. 1. FIG. 1 shows that when DMAPA is compared to MOPA, with regard to decomposition, at virtually any pressure and especially above about 200 psig the decomposition of DMAPA is significantly higher than MOPA.

A study of the effects of a relatively low pressure boiler on DEAE and DMAPA was undertaken. The study was conducted in a 175 psig package boiler. The boiler was operated at 41 cycles with no condensate return so that the amine present in the steam could only come from the feedwater and not from the return of condensate. DEAE and DMAPA were-fed simultaneously at 50 ppm to the feedwater. The boiler was operated overnight to allow the system to equilibrate. Table IV summarizes the results of the determination of the concentration of amines in the feedwater and the steam during the test period. The concentrations were determined by gas chromatography. The results show that the decomposition of high molecular weight amines such as DEAE and DMAPA is dependant upon conditions of temperature and pressure and that such amines are hydrothermally stable at the lower saturation pressures of this test.

TABLE IV

| | DEAE concentration (ppm) | | DMAPA concentration (ppm) | |
|---|---|---|---|---|
| Time | Feedwater | Steam | Feedwater | Steam |
| 1 | 55 | 55 | 44 | 42 |
| 2 | 54 | 51 | 44 | 42 |
| 3 | 53 | 52 | 45 | 42 |
| 4 | 51 | 54 | 44 | 42 |
| 5 | 53 | 50 | 46 | 42 |
| 6 | 51 | 55 | 44 | 42 |
| 7 | 45 | 50 | 38 | 40 |

Additional testing with the relatively high molecular weight amine DMAPA has indicated that in addition to DMA and TMA, other relatively low molecular weight amines also form. The formation of methylamine (MA) and dimethylaminopropanol (DMAP) has been confirmed. The formation of other, relatively low molecular weight amines may also occur in the practice of the present invention.

Additional testing with the relatively high molecular weight amine diethylaminoethanol (DEAE) confirmed it's partial decomposition into the volatile, relatively low molecular weight amines ethylaminoethanol (EAE) and diethylamine (DEA). This partial decomposition of DEAE occurred at conditions of temperature and pressure common to a typical boiler/condensate steam system. As shown by the examples, other relatively high molecular weight amines such as MOPA do not decompose at common boiler/condensate conditions.

As shown by the above data, the addition of a single select amine can give rise to the presence in a boiler/condensate system of a mixture of amines which provide a range of distribution ratios thereby providing improved system wide corrosion control. Selection and formulation of a single, high molecular weight amine which will at least partially decompose to lower molecular weight amines which are more volatile allows the ease of a single amine feed to provide the efficiency of multiple amine treatment. This efficiency is provided without the problems associated with the feeding of volatile, often highly flammable low molecular weight amines.

While certain features of this invention have been described in detail with respect to various embodiments thereof, it will, of course, be apparent that other modifications can be made within the spirit and scope of the invention, and it is not intended to limit this invention to the exact detail shown above except insofar as they are defined in the following claims.

What is claimed is:

1. A method of controlling corrosion in an aqueous boiler/condensate system by acid neutralization comprising treating said system with an effective amount of the relatively high molecular weight amine dimethylaminopropylamine and relatively low molecular weight amines selected from the group dimethylamine, trimethylamine, and diethylamine wherein said relatively low molecular weight amines are formed insitu by decomposition at pressures above about 200 psi of said relatively high molecular weight amine.

2. A method of controlling corrosion in an aqueous boiler/condensate system by acid neutralization comprising adding to the system an effective amount of the relatively high molecular weight amine dimethylaminopropylamine and exposing said relatively high molecular weight amine to a saturation pressure above about 200 psig in said system so as to at least partially decompose said high molecular weight amine into an effective amount for the purpose of acid neutralization of at least one relatively low molecular weight amine.

3. The method of claim 2, wherein said at least one relatively low molecular weight amine includes dimethylamine and trimethylamine.

* * * * *